United States Patent [19]

Olesen

[11] Patent Number: 4,785,580

[45] Date of Patent: Nov. 22, 1988

[54] MULTI-FUNCTION REVOLVING DOOR

[75] Inventor: Jørgen E. Olesen, Charlottenlund, Denmark

[73] Assignee: BMT International ApS, Charlottenlund, Denmark

[21] Appl. No.: 527,505

[22] Filed: Aug. 29, 1983

Related U.S. Application Data

[63] Continuation-in-part of Ser. No. 220,245, Dec. 23, 1980, abandoned.

[51] Int. Cl.[4] ..... E05D 15/02

[52] U.S. Cl. ..... 49/44

[58] Field of Search ..... 49/44, 45, 43, 42

[56] References Cited

U.S. PATENT DOCUMENTS

| | | | |
|---|---|---|---|
| 617,309 | 1/1899 | Cobb | 49/44 |
| 3,497,997 | 3/1970 | Sheckells | 49/43 |
| 3,526,820 | 9/1970 | Sheckells | 49/43 X |
| 3,678,623 | 7/1972 | Jenkins | 49/43 |
| 3,766,686 | 10/1973 | Sheckells | 49/43 |
| 3,782,035 | 1/1974 | Lowe | 49/44 |
| 3,886,684 | 6/1975 | Sheckells | 49/44 |
| 4,332,108 | 6/1982 | Appelmann | 49/44 |

*Primary Examiner*—Philip C. Kannan

*Attorney, Agent, or Firm*—Burgess, Ryan & Wayne

[57] ABSTRACT

A revolving door in which the center revolving support is generally cylindrical with a diameter at least 0.3 that of the space between the stationary walls of the door. Four door panels are hinged to the central member, and maintained in their normal positions by hydraulic door closers, so that the door panels can be rotated about their hinges to storage positions alongside the central member, and can be deflected when the door panels catch up to persons within the door. Radar type sensors detect the presence of people entering the doors, and speed up the rotation speed of the doors to facilitate movement through them. Proximity sensors on the door panels slow down the rotation of the door when a door panel begins to catch up to a person within the door. Door swing-back sensors detect when a door panel is pushed back (against the direction of door rotation) by contact with a person within the door, and cause the door to stop rotating upon such an occurrence. Means is also provided to store the door in a rotational position in which all four door panels engage stationary side walls, and to lock the door panels against the side walls in the storage position.

16 Claims, 4 Drawing Sheets

MULTI-FUNCTION REVOLVING DOOR

CROSS-REFERENCE TO RELATED APPLICATIONS

This application is a continuation-in-part of U.S. Ser. No. 220,245 filed Dec. 23, 1980, now abandoned.

BACKGROUND OF THE INVENTION

This invention relates to a multi-function revolving door, and more particularly to a revolving door which is capable of regular use as well as use for emergency exit purposes.

In order to allow a steady traffic of persons walking in and out of buildings, such as shopping centeers, hospitals, airports, etc., it is necessary to have door arrangements in order to keep the indoor climate under control. Three systems are available: air curtains, automatic sliding or swing doors, and revolving doors. These solutions are good from a technical point of view, but the known products available all have serious drawbacks.

Air curtains are extremely energy consuming and therefore costly to operate. In a cold climate, it is impossible to suppress a draft in town blocks caused by the tall, relatively warm air in the building, creating what is known as the chimney effect. Furthermore, air curtains cannot control the drifting-in of dust. Also, noise passes unhindered into the building.

Automatic sliding or swing doors are less expensive to operate than air curtains, but they let as much as up to ten times the quantity of cold air into the building (or air conditioned cold air out) as the quantity ventilated by revolving doors. Dust and noise inlet are also unsatisfactorily controlled, especially during peak hours.

The present state of art respecting revolving doors is exemplified by U.S. Pat. Nos. 906,175; 1,030,266; 1,303,988; 2,523,980; 3,782,035; 3,020,038; 3,497,997; and 3,766,686.

Revolving doors constitute the one construction ensuring a permanent seal between the outdoor and indoor air masses. They provide the buildings with excellent noise, dust and draft control, and very low energy loss, thus reducing operation costs, and costs of maintenance.

Revolving doors of known construction do not provide buildings with an emergency exit capacity of sufficient volume independent of the position of the revolving body, and are either (1) dependent on a turning of the revolving body to one of a limited number of positions before folding of the door leaves results in a free passage or (2) are capable of establishing only one passageway. The first arrangement is not practical for a panicky crown and thus not acceptable to the public authorities, and the second arrangement does not provide adequate escape volume.

Revolving doors of known design have the upper bearing for the revolving body supported above said body. They are in this respect dependent on the adjacent structure in the building or otherwise have a supporting structure integrated into the door canopy.

Traffic in and out of public buildings includes persons with shopping carts, baby carriages, and persons in wheel chairs, or otherwise handicapped. The capacity to let such "traffic units" pass can only be provided by revolving doors with large diameters, i.e., diameters exceeding two meters and often more than three meters. These large rotating bodies are relatively heavy constructions. The rotation of the revolving door, therefore, is often motorized to enable handicapped persons, and persons otherwise unable to push the door leaves, to pass.

The motor drive for the rotating body of a revolving door requires either space in the building structure below the door floor, or space and supporting structure in the superjacent building parts. The hard push caused by a relatively fast moving heavy door leaf catching up with a slowly walking person, or the more violent "bumps" executed by a door leaf hitting an immobile person or lost item, are technical problems not satisfactorily resolved until now.

SUMMARY

Accordingly, an object of the present invention is to provide a large motorized revolving door overcoming the aforementioned disadvantages of prior art revolving doors.

As herein described, there is provided an improved motorized revolving door wherein the center member has the cross sectional shape of a cross, a square, a circle or any other shape exhibiting a diagonal dimension (the distance between two opposite door leaves) of at least 30 percent of the door diameter.

According to the invention, there is provided a revolving door comprising first and second side members having arcuate inner walls symmetrically disposed about a door rotation axis; a generally cylindrical door central member mounted for rotation about said axis in a given direction, the transverse diagonal dimension of said member having a value at least equal to 0.3 of the distance between said walls as measured along a line extending through said axis, said member having four longitudinal hinge means; a door panel pivotally secured to each of said hinge means, each door panel having a normal position extending radially of said member and being capable of rotation through a first predetermined angle in said given direction and a second predetermined angle in the opposite direction; biasing means for urging each said door panel toward the normal position thereof from both of said directions and for opposing deflection of each door panel from said normal position with a predetermined threshold force or torque; latching means for retaining said door panels in an emergency position alongside said central member; motor drive means for rotating said central member in said given direction; and a control unit for controlling the operation of said motor drive means.

IN THE DRAWING

FIG. 1 is a partially exploded perspective view of a revolving door according to a preferred embodiment of the invention;

FIGS. 2*a* through 2*d* show various positions of the revolving door and its hinged door panels, which provide various operational functions of the door;

DETAILED DESCRIPTION

According to a preferred embodiment of the invention, each door leaf is hinged in such a way that it can swing clockwise and counter-clockwise relative to the central member of the rotating body, the normal position of the leaf being radially out from the center axis of the rotating body and having a holding power to be overcome, to swing a door leaf away from this normal position. Each door leaf has a switch for breaking the power supply to the motor driving the rotating body when the door leaft is swung in a direction opposite to its normal direction of rotation.

Each door leaf may have a hydraulic door mechanism of the type utilized in swinging doors, for enabling the door leaves to function with (i) a holding position when pointing radially from the center of the rotating body and (ii) other holding positions when swung to one of the extreme positions with the unhinged side of the door leaf as close as possible to the central member of the rotating body. In any other position the hydraulic mechanism will urge the door leaf back to the radially pointing position.

The central member of the rotating body may be a hollow structure providing space for the stationary structure rigid enough to support the upper bearing for the revolving body. This arrangement provides an installation independent of the building structure superjacent to the revolving door. The central member of the rotating body, being a hollow structure, may be shaped to house the motorized drive for turning the rotating body.

The motor drive is controlled by a control unit. The control unit may have provision for manual setting, input from touch-free sensors and outputs for the motor drive and automatic door locks. The space in front of each entrance (the outdoor and the indoor entrances) to the revolving door may be monitored by a touch-free sensor (radar-, radio-, light- or induction sensor) providing an output signal to the control unit when a person is approaching (wanting to pass the door), said signal resulting in an increase in rotation speed for providing comfortable passage.

Each door leaf may be equipped with a touchfree sensor monitoring the space in front of the door leaf (in the direction of the mechanical rotation) over a distance of about 25 centimeters (10 inches) and providing a signal to the control unit in case a part of a person or item is detected within the space covered, said signal resulting in an immediate reduction in rotation speed.

Figure 1:
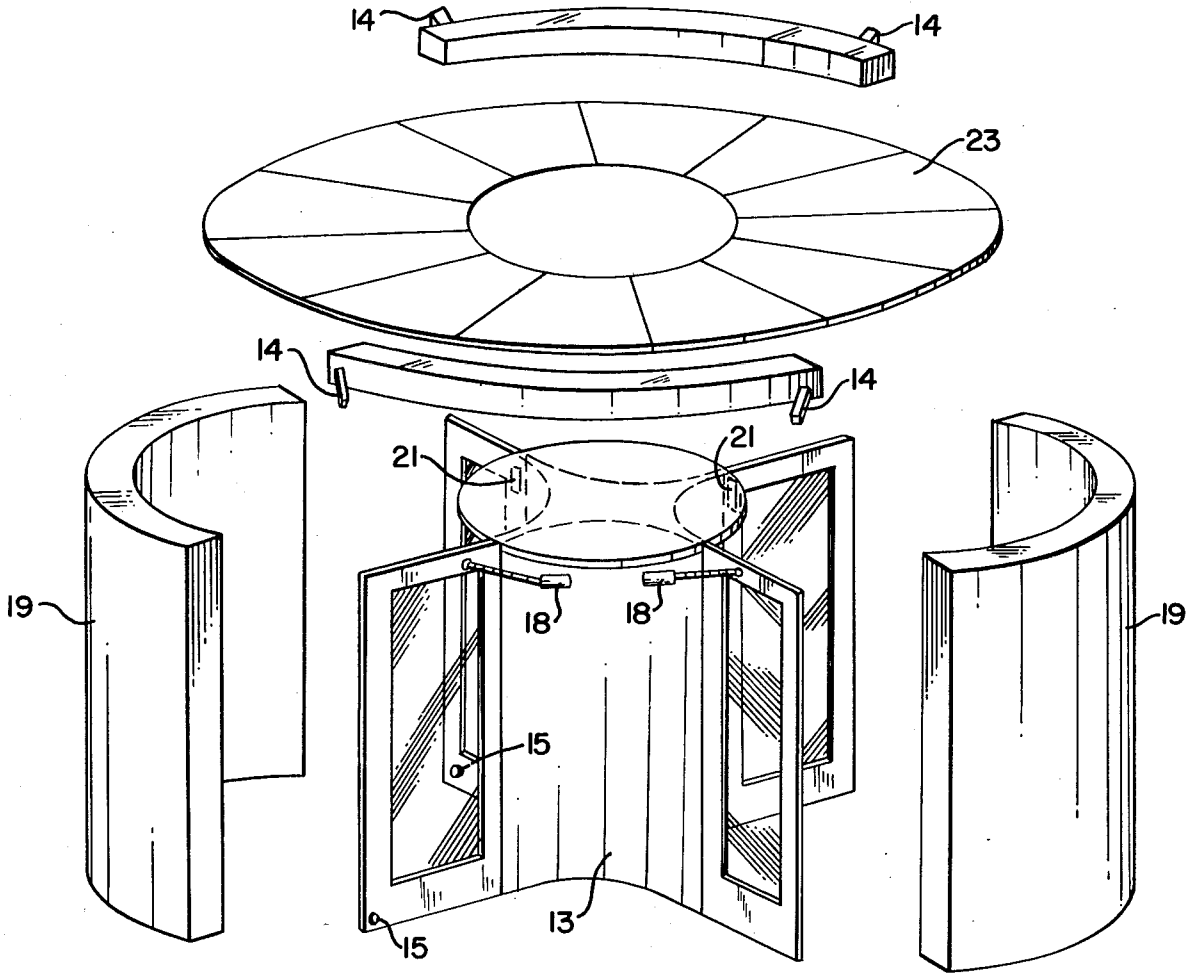

The motorized revolving door shown in FIG. 1 has a generally cylindrical rotatable door central member 13, which contains the electric motor drive to rotate said member; stationary side walls 19; and a canopy 23.

Figure 4:
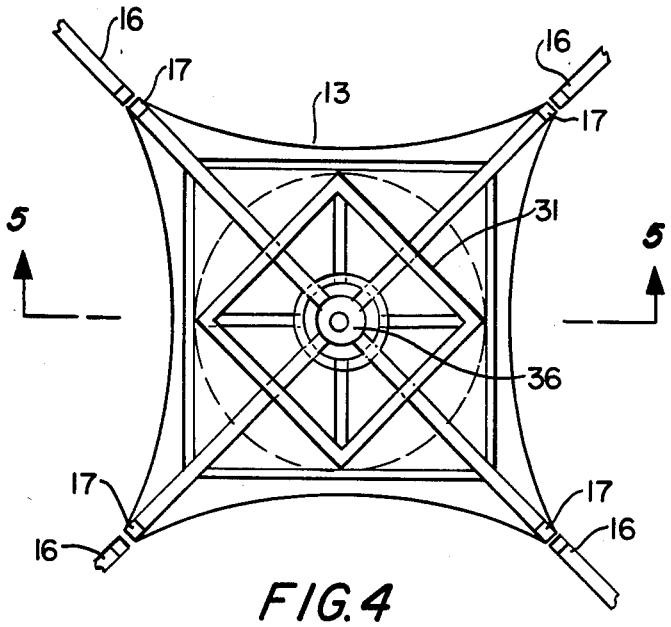
FIG. 4 is a top plan view showing the structure of the central portion of the door.
Figure 5:
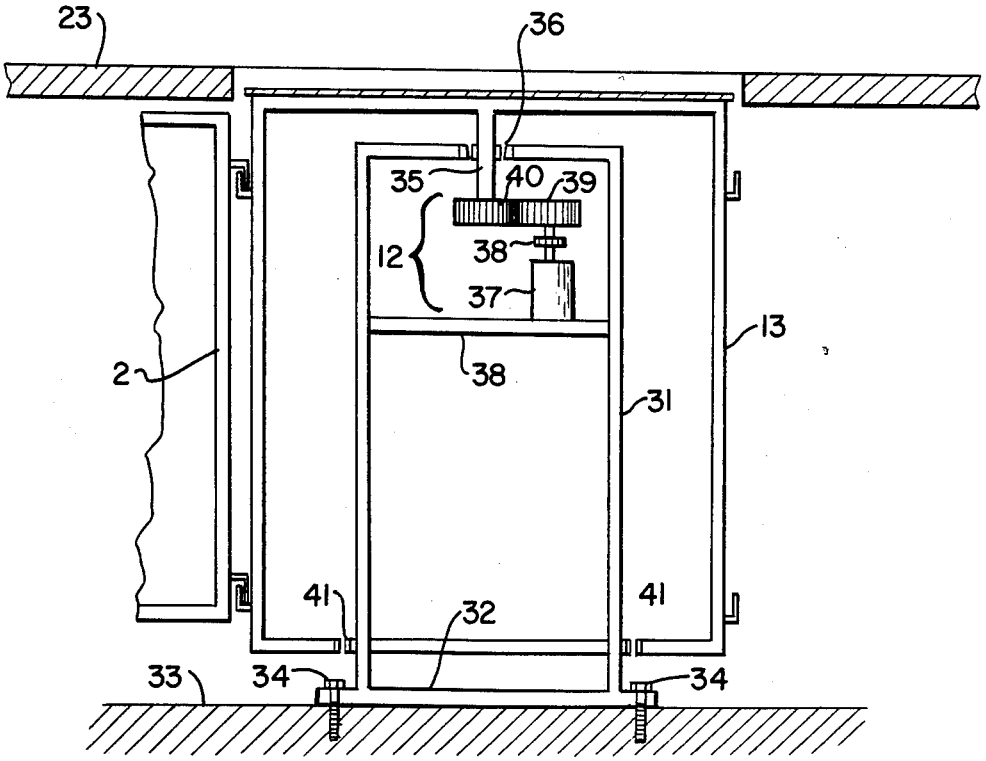
FIG. 5 is a cross-sectional front elevation view of said door central portion, taken along the cutting plane 5—5 shown in FIG. 4.

As best seen in FIGS. 4 and 5, the door central member 13 is rotationally supported by a central tower 31, which has a base 32 secured to the building floor 33 by suitable bolts 34. A support/drive shaft 35 is secured to, rotates and supports the upper portion of the door central member 13. The shaft 35 and door central member 13 are rotationally supported on the tower 31 by means of an upper bearing 36.

A door central member motor drive 12 consists of an electric motor 37 supported on a shelf 38 of the tower 31, and meshed drive gears 38, 39 and 40 for allowing the motor 37 to rotate the shaft 35 and door central member 13.

The lower portion of door central member 13 is rotationally guided by an idler bearing ring 41 which surrounds the lower portion of the tower 31.

Thus the support and drive arrangement for the door central member 13 is self-contained by virtue of the tower 31, so that the moving elements of the revolving door may be conveniently tested in the manufacturing plant, and subsequently rapidly and easily installed on the construction site, substantially independent of the building structure superjacent to the revolving door. As shown in FIG. 5, the motor drive mechanism may be entirely contained within the stationary tower 31, which may if desired, be made high enough to help support the canopy structure 23.

As best seen in FIGS. *2a* through *2d*, four door panels 16 extend radially from each of the "corners" 17 of the door central member 13, each panel being hinged at the corresponding corner, said panels being biased into the "normal" radial positions shown in FIG. *2a* by means of conventional hydraulic door closer mechanisms 18 (see FIG. 1).

Each door panel 16 is held in its normal radial position so that a certain minimum torque or force is required in order to swing it clockwise or counter-clockwise relative to said normal position. The required panel deflection torque is preferably in the range of 20 to 100 Newton-meters and is preferably manually adjustable. Any door panel left alone in a position between its normal position and one of its two extreme positions is influenced by a force generated by the corresponding door closer 18 to bring the door panel back to its normal position. We prefer a door closer of hydraulic type functioning within the range of 150° clockwise and 150° counterclockwise relative to the normal position, such as door closer type GEZE 360 W power Z F=150° from Gretsch & Co. GmbH, D-725 Leonberg, West Germany.

Although for clarity of explanation, the door closers 18 are shown in FIG. 1 as being visible to persons using the door, preferably they should be hidden above the level of the canopy 23.

As best seen in FIG. *2a*, the diagonal dimension C of the central member 13 is at least 0.3 of the revolving door diameter D, and is preferably on the order of 42% thereof.

The radial dimension R of the central member 13 is preferably at least about 75% of the door panel width d. The width of each of the door panels 16 is no greater than 35% of the width D of the revolving door; and the radial dimension R of the central member 13 is at least 15% of the revolving door width D.

Each of the door panels 16 is capable of swinging through an angle of at least 125° clockwise and counterclockwise relative to its normal position; said angle preferably being in the range of 125° to 135°.

In large diameter revolving doors providing passage for persons with large dimension items, the radial distance R between the rotation axis and door panel hinge axis may be in the range of 0.15 to 0.35 times the door diameter D, and the door will provide acceptable emergency exit for the building served by the door. Revolving doors with small diameters will not usually provide emergency passageways of sufficient width if made according to the present invention. Doors according to the present invention are for this reason most suitable for doors with diameters exceeding two meters.

At night or when the building is closed, the control switch 11 is set to a "Lock" position, which causes the control unit 10 to rotate the central member 13 (via the motor drive 12) to a locked position as shown in FIG. *2a*, wherein all four door panels 16 abut the arcuate stationary walls 19. A door central member position sensor 20 coupled to the motor drive 12 and central member 13 provides a signal to the control unit 10 indicating when the central member 13 has reached the Lock position. Thereupon the control unit 10 engages the automatic door panel locks 30 to prevent rotation of the door panels 16 on their hinges. The door panel locks 30 are preferably disposed substantially in the structure of the canopy 23.

Figure 2A:
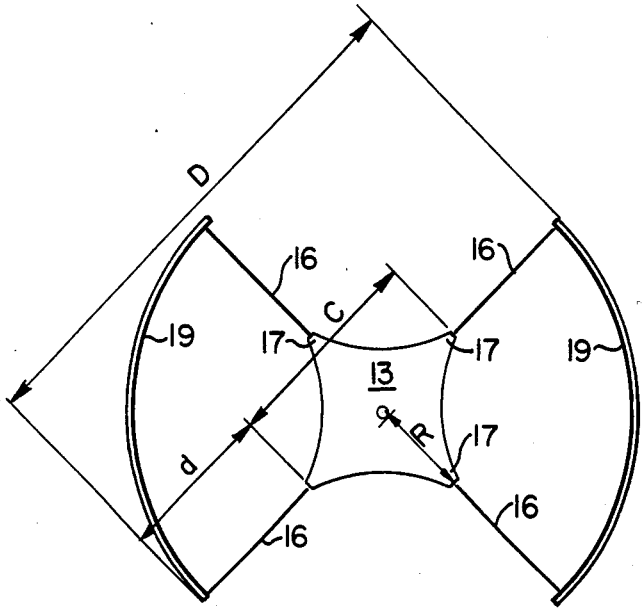

When it is evening, or at other times when building traffic is low, or when the door rotation is to be stopped for any other reason, the control switch 11 is set to a "Stop" position in which the central member 13 remains stationary in the position shown in FIG. 2*a* but the automatic door panel locks 30 are not activated, so that individuals may traverse the revolving door by pushing two aligned door panels. Where automatic evening operation is desired, the control unit 10 may be set ("Evening" position of switch 11) so that each time a person is detected by one of the ultrasonic or radar Doppler-effect detectors or entry sensors 22, the control unit causes the central member 13 to rotate for a period of 2 minutes, during which operation is as hereafter described for the "Day" modes.

Figure 2B:
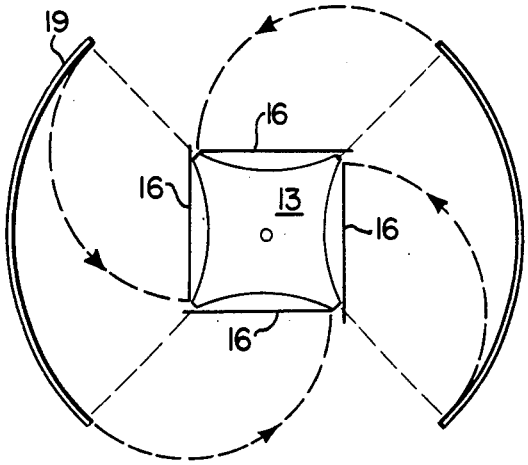
Figure 2C:
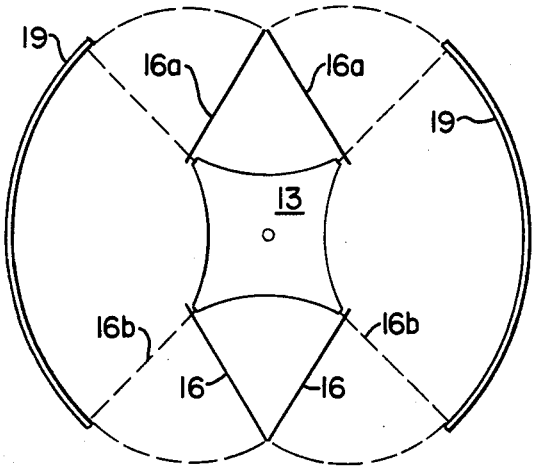
Figure 2D:
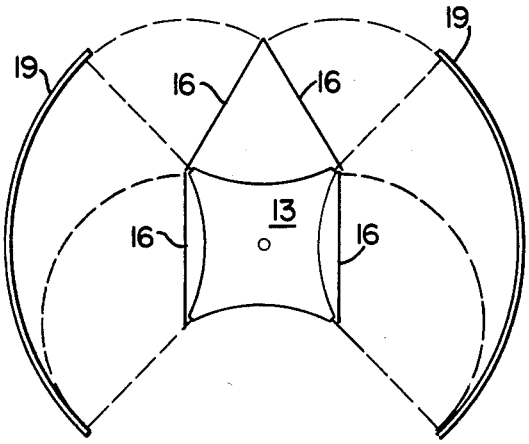

When rapid and/or unobstructed ingress and egress through the revolving door is desired, for example during the summer, the door panels 16 may be manually rotated to the positions shown in either FIG. 2*c* or 2*d*, and maintained in said positions by conventional (automatically operating) retainers, which are a part of each of the hydraulic closers 18.

In an emergency, the door panels 16 may be manually rotated to lie flat against the central member 13 as shown in FIG. 2*b*, and maintained in said positions by the aforementioned retainers. The resulting emergency passageways are available independently of the position in which the revolving door central member has stopped; and regardless of whether the central member 13 is moving or stationary. The utilization of the emergency passageway does not require use of any tools or maneuvering or handles; a simple pressing force applied to a door panel will open up the passageway.

Thus our motorized revolving door provides the advantages of a revolving door and simultaneously a permanently and instantly available emergency exit for a panicky crown, the emergency exit comprising a permanent indoor opening to the revolving door, two passageways around the central member 13, and a permanent opening from the revolving door to the outside area. The total width of the emergency passageways throughout their extension equals or exceeds the width of the permanent openings to the revolving door.

This combination of functions eliminates the need for additional wall area and floor space for placing an emergency exit door next to a revolving door; and improves security by eliminating an opening in the building wall.

Figure 3:
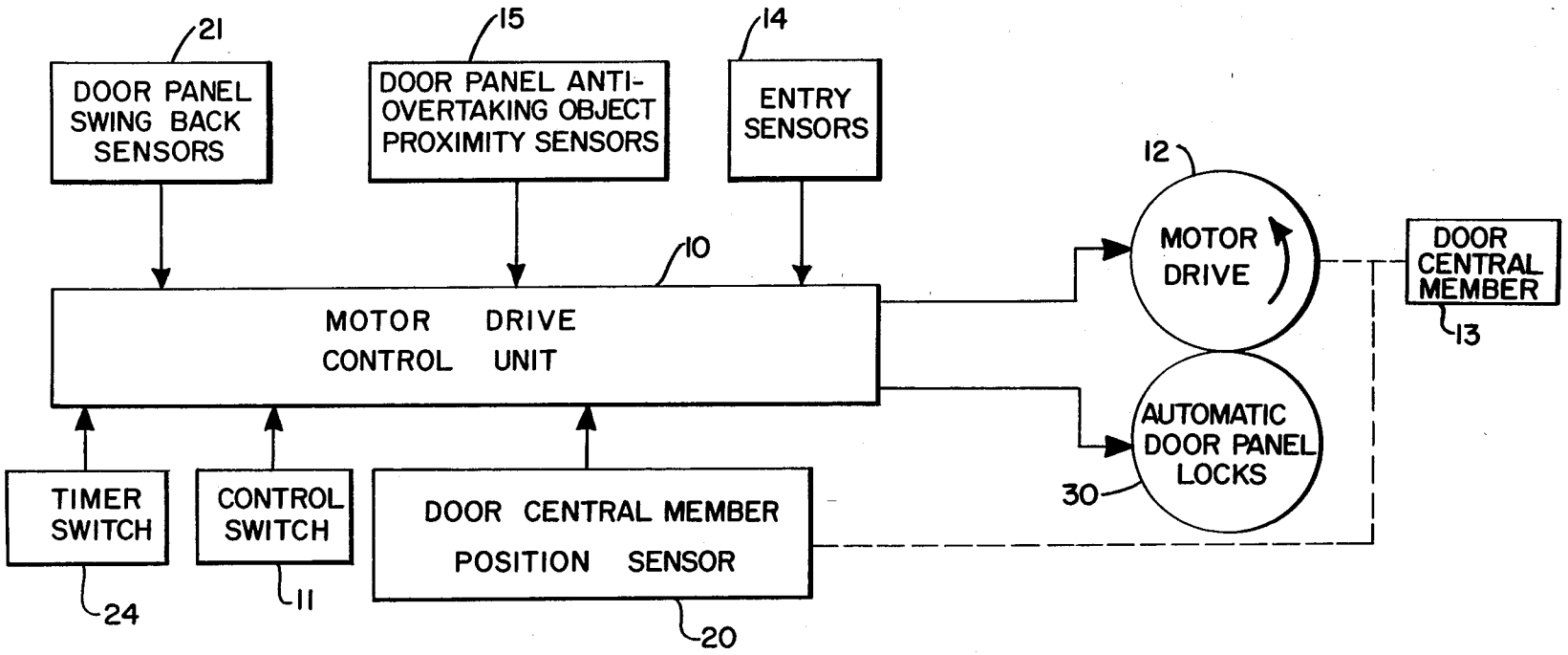
FIG. 3 is a functional block diagram showing the manner in which the operation of the door is controlled.

The motor control unit 10 (FIG. 3) is operated buy a control switch 11 which has a position "Day" allowing the motor drive 12 to turn the door central member 13 counterclockwise with a speed of one revolution per minute (r.p.m.) except when a person is recognized by one of the entry sensors 14, in which case the control unit 10 increases the speed to be four r.p.m. This speed is maintained during one full revolution, after which the speed is again reduced to one r.p.m. The slow 1 r.p.m. "resting speed" indicates the direction in which to pass through the door and also reduces the time required to reach the desired 4 r.p.m. speed for passage.

If a person entering the revolving door moves too slowly, in relation to the speed of the door, his presence is recognized by the corresponding one of the proximity sensors 15 mounted on the door leaf catching up with him, resulting in an immediate reduction of rotating speed of the member 13 to 1 r.p.m. and thus preventing an overtake.

If a person falls or loses an item, he or it is reached by a door panel 16 moving at slow speed only since the proximity detectors 15 have reduced the speed of the door. The slow moving door panel is then swung back in the clockwise direction by engagement with the person, relative to the central member 13. The deflection of the door panel from its normal position is detected by the corresponding one of the door panel swing-back sensors 21, which sends a corresponding signal to the control unit 10 to cause it to stop the rotation of the central member 13. When the person moves forward (counterclockwise) or backward (clockwise) away from the door panel, the panel returns to its normal position and the central member 13 thereupon resumes its rotation.

In case of an electrical failure, the door functioning is as described under control switch position "Stop". If the blackout period is expected to last a long time, door panels may be swung to the positions 16*a* as shown in Fig.2*c*, leaving only one swingdoor 16*b* to be passed during entering or leaving the building.

The control unit 10 is an electronic control unit on the front panel of which there is a timer switch 24 for recording the number of hours the door has been rotating. If desired, the switch 24 may be programmed to automatically switch the control unit 10 between Day, Evening and Lock modes at predetermined times.

The control unit 10 produces output signals for the motor drive 12 and for the automatic door panel locks 30. Signals for the motor drive are "stop", "slow speed", and "high speed". Signals for the solenoid-operated door panel locks are either "lock" or "release". The door panel swing-back sensors 21 are placed so that each one senses whether one of the four door panels 16 is swung back from its normal, radial position relative to the central member 13. Swinging back is swinging against the direction of the motor drive rotation, i.e., swinging clockwise. If one door panel is swung back, the corresponding sensor emits a signal to the control unit to cause an immediate stop of the motor drive. A normal door panel position or a position swung forward does not produce any signal, thus allowing orders of lower priority to be executed. The door swing-back sensors may be position sensors of magnetic type, i.e., ESBi 100 S obtainable from ELTRONIC, CH-3073 Grumlingen, Switzerland.

The door panel anti-overtaking sensors are mounted one on each of the door leaves registrating and reporting by sending a signal in case a body or an item appears approximately 25 cm (10 inches) in front of the door panel. "In front" means in the direction given by the mechanical rotation (normally counter-clockwise). The signal is a "slow speed" signal and is in priority second to a "stop" signal produced by any door panel swing-back sensor. The anti-overtaking sensors are of the "touch-free" type, preferably a light sensor, i.e., a Dihlogik OIS 20, obtainable from WEEDER-ROOT DENMARK, DK-2670 Greve Strand, Denmark.

The entry sensors 22 are placed to cover each of the two entrances to the revolving door; the outside entrance and the inside entrance. The sensors are of the non-contact type, preferably of the ultrasonic or radar type distance-responsive or Doppler effect, i.e., Doormaster type MW 02, manufactured by H.E. Michelsen Pty. Ltd., Pymble, NSW 073, Australia.

When an approaching person or moving object is detected by any of the entry sensors 14, a signal "passage is wanted" is emitted to the control unit 10. The control unit 10 responds to this input by producing an output signal "high speed" to the motor drive 12; this signal being maintained during approximately the time needed for the central member to rotate one full revolution running at high speed, i.e., ¼ minute. The order is executed to the extent no orders of higher priority are received from any of the door panel sensors.

The door central member position sensor 20 is mounted on the central member 13 for producing a "stop" signal once during each rotation of the central member. The "stop" signal enables the control unit to stop the motor drive exactly when the central member is turned to a position placing two door panels (each with a lockplate opposite an automatic tie bolt on the wall(s) 19) just inside the outdoor entrance to the door. The door central member position sensor 20 is preferably of the magnetic type, i.e., the very same type used as door panel swing-back sensor type ESBi 100 S, obtainable from ELTRONIC, CH-3073 Grumlingen, Switzerland.The "stop" signal from the door central member position sensor is inhibited in the control unit 10 except when the control switch 11 is set on either "Lock" or "Stop". If the control switch 11 is turned to "Night", the "stop" signal from the door central member position sensor 20 is inhibited in the control unit 10 for approximately two minutes after the last "passage wanted" signal is received from a door entry sensor 14.

What is claimed is:

1. A revolving door, comprising:

first and second side members having arcuate inner walls symmetrically disposed about a door rotation axis;

a door central member mounted for rotation about said axis in a given direction, the transverse diagonal dimension of said member having a value at least equal 0.3 of the distance between said walls as measured along a line extending through said axis, said member having four longitudinal hinge means;

a door panel pivotally secured to each of said hinge means, each door panel having a normal position extending radially of said member and being capable of rotation through a first predetermined angle in said given direction and a second predetermined angle in the opposite direction;

biasing means for urging each said door panel toward the normal position thereof from both of said directions and for opposing deflection of each door panel from said normal position with a predetermined threshold force or torque;

motor drive means for rotating said central member in said given direction; and a control unit for controlling the operation of said motor drive means.

2. The revolving door according to claim 1, further comprising a door central member position sensor for detecting a predetermined rotational position of said central member wherein edges of all four of said door panels remote from said hinge means engage said stationary walls, said control unit including means for stopping the rotation of said central member at said predetermined rotational position in response to a stop mode signal.

3. The revolving door according to claim 2, wherein said control unit further comprises means for both stopping said central member in said predetermined rotational position and thereafter locking each of said side walls or canopy structure to an adjacent edge of at least one of said door panels, in response to a lock mode signal.

4. The revolving door according to claim 2, further comprising means for securing said remote edges of adjacent door panels in mutual juxtaposition.

5. The revolving door according to claim 1, or 2, or 3 or 4, further comprising swing-back detection means for sensing deflection of each of said door panels in said opposite direction from said normal positions thereof, and means including said control unit for stopping the rotation of said central member upon sensing of such deflection by said swing-back detection means.

6. The revolving door according to claim 1 or 2 or 3 or 4, further comprising anti-overtaking proximity detection means on each of said door panels for sensing the presence of an object within a predetermined distance from the corresponding door panel in said given direction, said control unit including means for decreasing the speed of rotation of said control member upon sensing of said object by said anti-overtaking proximity detection means.

7. The revolving door according to claim 1 or 2 or 3 or 4, further comprising entry detection means for sensing the presence of moving objects adjacent the revolving door, said control unit including means for increasing the speed of rotation of said central member upon sensing of said moving object by said entry detection means.

8. The revolving door according to claim 1, wherein the radial distance of each of said hinge means from said rotation axis is in the range of 0.15 to 0.35 of said distance between said walls.

9. The revolving door according to claim 8, wherein said radial distance is between 20% and 30% of said distance between said walls.

10. The revolving door according to claim 8 or 9, wherein said radial distance is on the order of about 75% of the width of said door panels, said panels each having substantially the same width.

11. The revolving door according to claim 1 or 2 or 3 or 4, further comprising latching means for retaining said door panels in an emergency position alongside said central member.

12. The revolving door of claim 1, wherein said first predetermined angle is between 125° and 135°.

13. A revolving door, comprising:

first and second side members having arcuate inner walls symmetrically disposed about a door rotation axis;

a door central member mounted for rotation about said axis in a given direction, the transverse diagonal dimension of said member having a value at least equal to 0.3 of the distance between said walls as measured along a line extending through said axis, said member having four longitudinal hinge means;

a door panel pivotally secured to each of said hinge means, each door panel having a normal position extending radially of said member and being capable of rotation through a first predetermined angle in said given direction and a second predetermined angle in the opposite direction;

biasing means for urging each said door panel toward the normal position thereof from both of said directions and for opposing deflection of each door panel from said normal position with a predetermined threshold force or torque;

latching means for retaining said door panels in an emergency position alongside said central member;

motor drive means for rotating said central member in said given direction;

a controlunit for controlling the operation of said motor drive means;

a door central member position sensor for detecting a predetermined rotational position of said central member wherein edges of all four of said door panels remote from said hinge means engage said stationary walls, said control unit including means for stopping the rotation of said central member at said predetermined rotational position in response to a stop mode signal;

means for locking each of said side walls to an adjacent edge of at least one of said door panels, in response to a lock mode signal;

means for securing said remote edges of adjacent door panels in mutual juxtaposition;

swing-back detection means for sensing deflection of each of said door panels in said opposite direction from said normal position thereof, and means including said control unit for stopping the rotation of said central member upon sensing of such deflection by said swing-back detection means;

anti-overtaking proximity detection means for sensing the presence of an object within a predetermined distance from the corresponding do in said given direction, said control unit.including means for decreasing the speed of rotation of said central member upon sensing of said object by said anti-overtaking proximity detecting means; and entry detection means for sensing the presence of moving objects adjacent the revolving door, said control unit including means for increasing the speed of rotation of said central member upon sensing of said moving object by said entry detection means.

14. The revolving door of claim 1 or 13, wherein said motor drive means is disposed substantially within said central member.

15. The revolving door according to claim 1 or 13, further comprising a stationary tower disposed within and supporting said door central member.

16. The revolving door according to claim 15, further comprising an upper central bearing for rotatably coupling the top of said door central member to the upper portion of said tower, and a lower bearing ring surrounding the lower portion of said tower for rotationally guiding the lower portion of said door central member.

* * * * *